United States Patent [19]

Simon

[11] 4,175,462

[45] Nov. 27, 1979

[54] SYSTEM FOR SELECTION AND PHASE CONTROL OF HUMBUCKING COILS IN GUITAR PICKUPS

[76] Inventor: Jonathan C. Simon, 1451 26th St., Santa Monica, Calif. 90404

[21] Appl. No.: 807,368

[22] Filed: Jun. 17, 1977

[51] Int. Cl.[2] ..... G10H 3/00

[52] U.S. Cl. ..... 84/1.16; 84/1.15; 84/1.24; 84/1.27; 84/1.11

[58] Field of Search ..... 84/1.01, 1.14, 1.15, 84/1.16, DIG. 10, 1.27, 1.11, 1.19, 1.24; 330/86

[56] References Cited

U.S. PATENT DOCUMENTS

| | | | |
|---|---|---|---|
| 3,915,048 | 10/1975 | Stich | 84/1.16 X |
| 3,935,781 | 2/1976 | Katoh et al. | 84/1.19 X |
| 4,002,994 | 1/1977 | Fender | 84/1.14 X |
| 4,010,667 | 3/1977 | Kniepkamp | 84/1.24 X |
| 4,079,334 | 3/1978 | Hamilton | 84/1.24 X |

*Primary Examiner*—Ulysses Weldon
*Attorney, Agent, or Firm*—Freilich, Hornbaker, Wasserman, Rosen & Fernandez

[57] ABSTRACT

A system for the selection and phase control of humbucking coils in electromagnetic guitar pickups to permit the musician to easily select different sounds using digital memory means for storing different combinations of gate control bits to select the pickup coils to be used, the phase of the coils selected and the output level of the selected coils combined. A three-way switch is used to count up, count down or hold a memory address for selection of a combination. The address is displayed for verification. Memories may be prestored ROMs, or alterable RAMs in which write enable control is controlled by a three-way switch. Three address counters may be provided to permit the musician to quickly select from three predetermined combinations through operation of a three-way switch.

8 Claims, 3 Drawing Figures

SYSTEM FOR SELECTION AND PHASE CONTROL OF HUMBUCKING COILS IN GUITAR PICKUPS

BACKGROUND OF THE INVENTION

This invention relates to a complex switching system with memory for electronically amplified guitars, and more particularly to guitars employing humbucking coils for electromagnetic pickup from guitar strings, to permit the musician to easily select different sounds previously programmed and stored in memory in terms of at least the pickup coils to be used, the phase of the coils selected and the output level of the selected coils combined.

A humbucking guitar pickup consists of two coils wound in parallel, side by side, but with reverse magnetic polarity in order to cancel any hum, but not the actual notes of the guitar strings. The humbucking coils also color the sound. Such coloration is commonly used to advantage. In a normal electric guitar, there are provided two sets of pickup coils, a front pickup, a back pickup and a three-way selector switch which permits the musician to select either or both pickups. Also provided are independent tone control and volume control for each pickup. These controls permit the musician to color the sound for the particular type of music they are playing.

Most professional musicians have a repertoire of music of different types, so they use different guitars, one for each type, already preset. In that way time is not lost during a performance in readjusting controls for the different types of music. What is desired is a way to store all of the colorations (tonal characteristics) of the different types of music in one guitar in such a way that any particular one can be easily and quickly called out of storage. The time then lost could be less than the time the musician would need to set one guitar down and take up another.

For optimum control of tonal characteristics, the paired humbucking coils are separately controlled through selection switches, with the phase of a coil selected either inverted or not. With two pickups, for example, there are four coils which provide a total of fifteen combinations of just coil selection. When one also provides for separate phase control of each coil selected, there are theoretically 64 possible combinations, although some are redundant in the sense that they produce the same net effect as others, so that in actuality there may only be 59 useful combinations. But then upon combining the pickup of selected and phased coils, there is also a need to adjust the volume since a given combination may provide more input signal amplitude to the power amplifier than another, and beyond that, there may be different volume selections to be made. To incorporate all of the possible combinations requires of the musician such complex switching combinations that it is practically impossible for him to do so during a performance as he goes from one song or number to another. Thus, what is required is a memory to prestore all of the desired combinations for electronic recall with a minimum of addressing operations for the musician to remember and perform.

SUMMARY OF THE INVENTION

In a guitar employing 2N coils in N pairs, where N is a whole integer, an addressable memory means provides at least three control words: one to provide a control word to determine whether each coil is to be selected or not; one to provide a control word to determine whether the selected coil output is to be phase inverted or not; one to provide a control word to select the output volume of the selected and phase controlled coils combined, all under control of a three-way switch which controls an address counter to count up when toggled in one direction, to count down when toggled in the other direction, or to hold while in the center position.

In a preferred embodiment, the memory means is provided to be read only with the proper control words for the different combinations prestored. In another embodiment, the memory means is provided for read and write operation so that the musician may store the combinations desired. A second three-way switch is provided to enable separate sections of the memory means to store the different control words individually. A set of data switches are temporarily connected to the sections of the memory means to set up the control words to be stored in the different memory sections. A store-command pushbutton is also temporarily connected to the memories.

In still another embodiment, a plurality of up-down counters are provided, each selectably controlled to count up and down with the first three-way switch, the counter being selected by another multiposition switch. Once addresses are set up in the counters, the musician can select any counter with the multiposition switch to enable its output to be transmitted to the memory means.

The novel features that are considered characteristic of this invention are set forth with particularity in the appended claims. The invention will best be understood from the following description when read in connection with the accompanying drawings.

DESCRIPTION OF THE PREFERRED EMBODIMENTS

Figure 1:
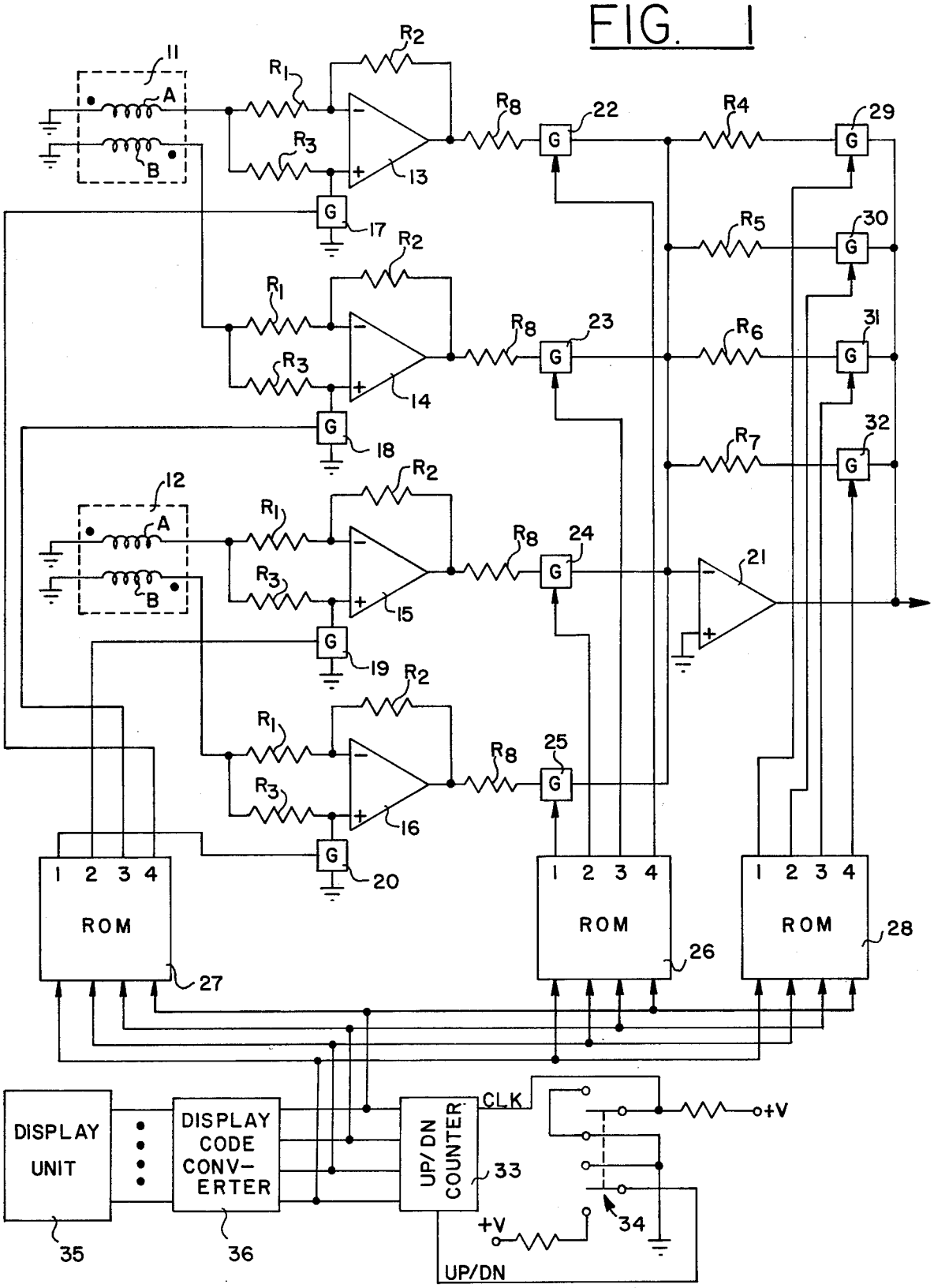
FIG. 1 is a block diagram illustrating a preferred embodiment.

Referring now to FIG. 1 of the drawings, a preferred embodiment is illustrated using only two humbucking pickups 11 and 12, one mounted up front (near the bridge) under the strings of a guitar (not shown), and one mounted in back (near the fretted neck). Each electromagnetic pickup is comprised of two coils, a first coil A parallel to a second coil B, but wound to pick up sound waves with opposite polarity, i.e., wound with opposite sense, as indicated by the dot convention. Consequently, in the preferred embodiments, there are $2N=4$ coils, where N is the number of pickups (paired coils).

Each coil is connected to the inverting (−) and non-inverting (+) input terminals of a separate operational amplifier. There are therefore 2N amplifiers identified in the drawing by the reference numerals 13, 14, 15 and 16. Coil A of each pickup is connected to the inverting input terminal of an amplifier by a resistor $R_1$ equal to a feedback resistor $R_2$. Similarly, coil B of each pickup is connected to the inverting input terminal of an amplifier by a resistor $R_1$ equal to a feedback resistor $R_2$. Coils A and B of the pickups 11 and 12 are also connected to the noninverting input terminals of the separate amplifiers by resistors $R_3$. The noninverting input terminals of the amplifiers 13–16 are also connected to circuit ground by gates 17–20, respectively. Resistors $R_1$ and $R_2$ are selected to be equal for unity gain when operated as inverting amplifiers while the respective gates 17–20 are "on", i.e., while those gates are shunting the noninverting input terminals to ground. (Resistor $R_3$ need not be but is conveniently selected to be equal to $R_1$ and $R_2$.) When the gates are "off," the amplifiers operate as noninverting amplifiers such that the outputs follow the inputs from the coils in phase. The amplifiers 13–16 may thus be controlled to invert or not invert the phase of the signals from their associated coils by control of respective gates 17–20 to be on or off.

Each amplifier is connected to a summing junction of an operational amplifier 21 by a separate gate identified by the reference numerals 22 through 25. Selective summing of the inverted or noninverted (i.e., phase selected) outputs of the separate coils is thus controlled by turning the gates 22–25 on or off. The conductive states of the gates 22–25 are controlled by a 4-bit control word from a first read-only memory (ROM) 26, while the conductive states of the gates 17–20 are controlled by a second read-only memory 27. Meantime, the gain of the amplifier 21 is controlled by the output of a third read-only memory 28 through the control of the conductive states of gates 29 through 32 which couple the output of the amplifier 21 to respective feedback resistors $R_4$, $R_5$, $R_6$ and $R_7$ which have different values relative a separate coupling resistor $R_8$ from each of the amplifiers 13 through 16. For example, resistors $R_4$ through $R_7$ may have values of 200KΩ, 500KΩ, 1MΩ and 1MΩ, to provide the following selectable gains: $0.2/R_8$, $0.5/R_8$, $0.7/R_8$, $1/R_8$, $1.2/R_8$, $1.5/R_8$, $1.7/R_8$, $2/R_8$, $2.2/R_8$, $2.5/R_8$ and $2.7/R_8$.

In this first embodiment, it is evident that the first, second and third ROMs may, in actuality, be sections of a single ROM which produces 12-bit control words in response to an address from a single up-down(UP/DN) counter 33 operated to count up or down to a desired address by a three-way selector switch 34, a double-poled, double-throw switch with a center position. When in the center position, as shown, the counter is "off," and in the off condition, the counter will hold its last count. When the switch is operated up, the lower contact grounds the UP/DN control line while the upper contact produces a negative-going step wave or clock (CLK) to advance the counter by one. To advance the counter by more than one, the musician merely toggles the switch between the off position and the up position a number of times. To reverse the counter one or more counts, the musician simply toggles the switch down one or more times. When the desired address is reached, as viewed on a display unit 35 driven by a display code converter 36 from the address output of the counter, the musician stops toggling the switch. He has then selected the desired combination of coils, phase and gain from the first, second and third ROMs, or first, second and third 4-bit bytes of a 16-bit word from a single ROM.

It should be noted that while only a 4-bit code is illustrated for the gain setting, in actuality the control word length of the ROM 28, or its equivalent if a single ROM is used, may be made longer for additional gain combinations of more than four feedback resistors to be stored in the memory. For example, two additional feedback resistors and gates could be added for control by a 6-bit gain control code.

Figure 2:
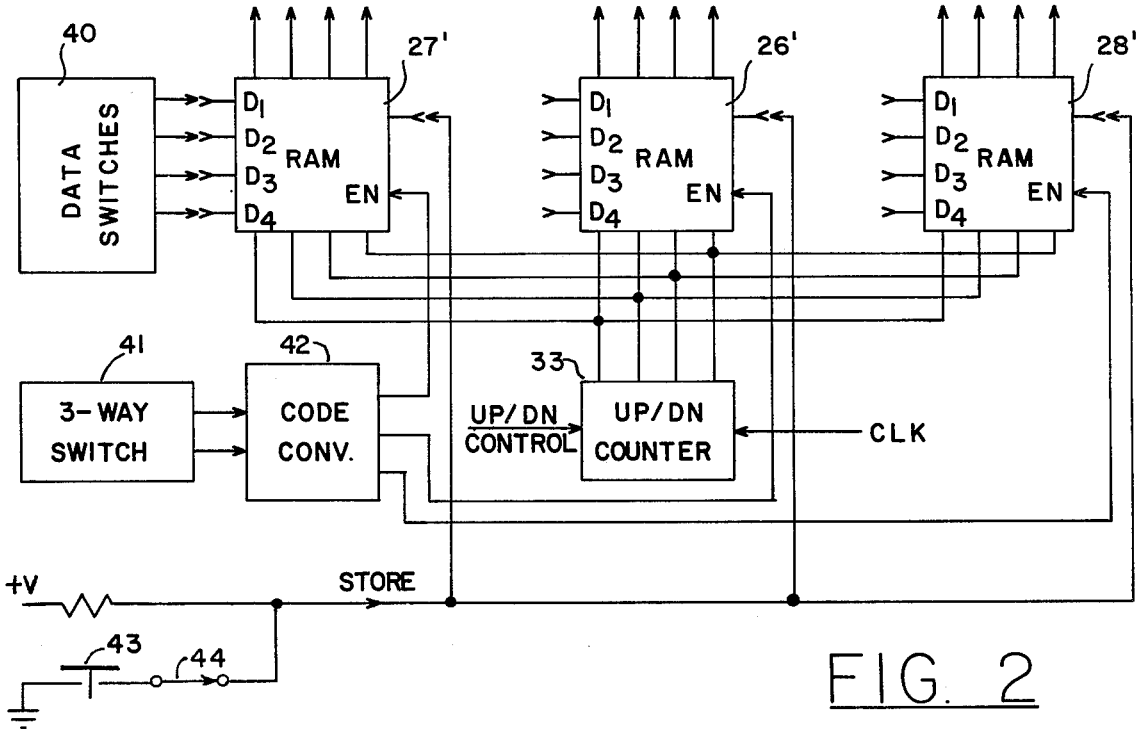
FIG. 2 illustrates a variant of the preferred embodiment.

In a second embodiment illustrated in FIG. 2, the ROMs are replaced by RAMs 26', 27' and 28'. The remainder of the first embodiment of FIG. 1 remains the same and is therefore not repeated in FIG. 2, except for the up-down counter 33. Data switches 40 are temporarily connected to data input terminals $D_1$, $D_2$, $D_3$ and $D_4$ of the RAMs to store 4-bit data words in memory locations addressed by the counter 33, but only in one RAM at a time, whichever is enabled by a three-way switch 41 similar to the one shown in FIG. 1. A code converter 42 detects and decodes the three states 01, 10 and XX, where a bit 0 is represented by ground potential, a bit 1 by a positive potential, and XX is represented by no positive potential on either switch contact, to enable only one memory, the first RAM when the switch is in the center, the second RAM when the switch is in the up position, and the third memory when the switch is in the down position. Once the data has been set up, the memory address has also been set up in the counter 33, the RAM is selected and a store push-button 43 is momentarily closed to generate a negative step-wave as a store command. A second switch 44 may be provided to disconnect the store command button in order to avoid inadvertent storing of a control word. Each RAM is provided with an output buffer, as is each ROM in FIG. 1, so that upon being addressed, the content of the addressed location is read out and retained. New data may then be stored in the addressed location and when that location is again addressed, it will be read out.

Figure 3:
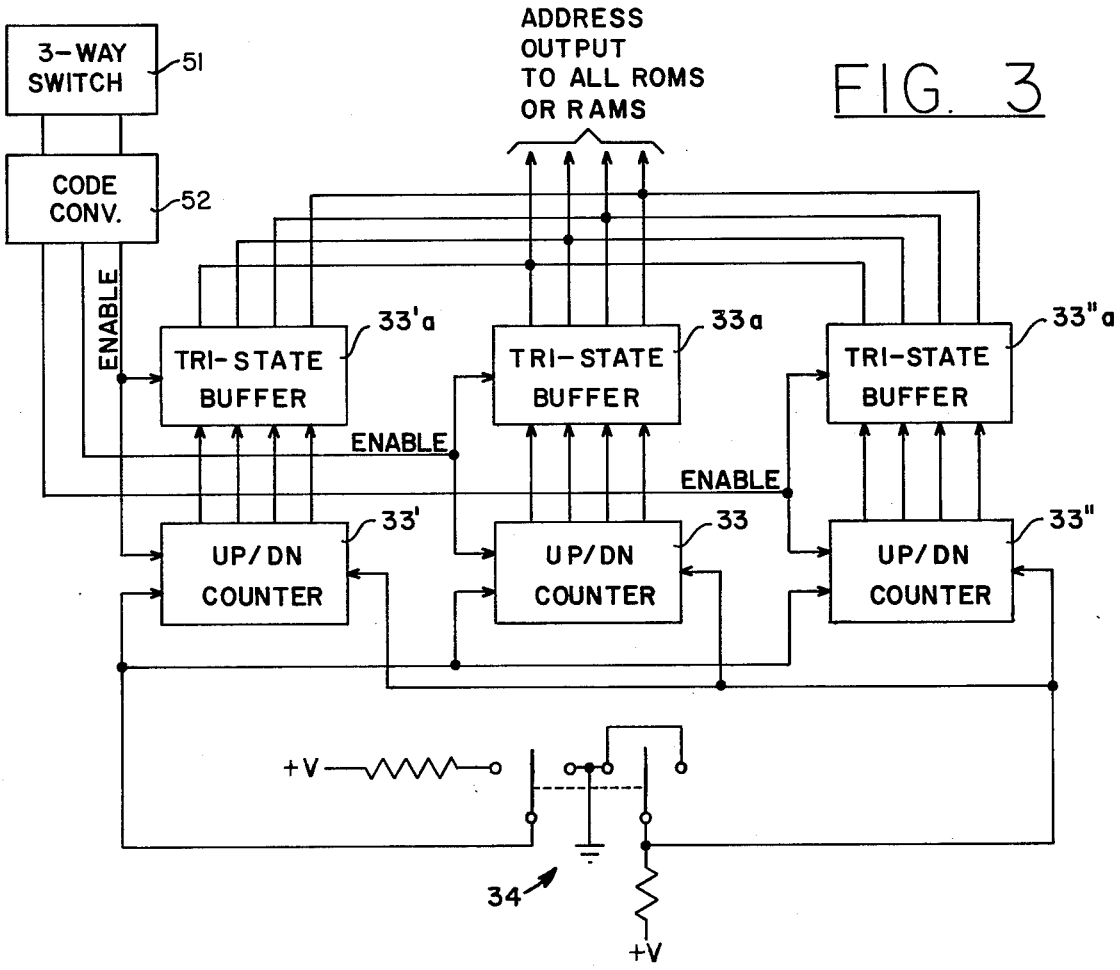
FIG. 3 illustrates still another variant of the preferred embodiment.

FIG. 3 illustrates a variant of the second embodiment in which the counter 33 is but one of three. The other two are designated 33' and 33''. Any one of the three counters is selected for addressing by a three-way switch 51 via a code converter 52 similar to the switch 41 and converter 42 (FIG. 2). Once an address is set up in one counter, another may be selected, and once three addresses are set up, one in each counter, the musician can quickly switch from one to the other with the three-way switch 51. Each counter 33, 33' and 33'' is coupled to the ROMs, or RAMs, by tristate buffers **33*a*, 33*a'* and 33*a''*, respectively, and the output of each buffer is enabled by the three-way switch 51 in the same manner as its associated counter. In that way, only one address is transmitted at a time to the ROMs or RAMs. This feature could obviously be expanded to provide more counters and tri-state buffers, but that would require more than a simple three-way switch on the guitar for the musician to operate, such as a rotary switch having M positions, one for each of M counters, or a simple triple-pole, double-throw switch could be used to connect the three-way switch 51 and code converter 52** to a second bank of three counters and tri-state buffers. The musician then simply selects one of three out of an upper or lower bank of three counters.

In an exemplary embodiment, the operational amplifiers used were selected to be μA741 made by Fairchild, and the resistors $R_1$, $R_2$ and $R_3$ were each selected to be 100K ohms. The gates 17–20, 22–25 and 29–32 were selected to be CMOS 4016 quad digital or analog bilateral switches used in the analog switch mode. For embodiments using RAMs, the memories 26–28 may be CMOS 5101 static random-access memories made by Intel which has an enable input terminal for enabling read or write operations, and a read or write (R/W)

control terminal. To write, that terminal is connected to ground, as by the pushbutton 43 shown in FIG. 2. It is in the read mode at all other times. It also has a further control terminal that is held high for normal operation, and low for micropower hold operation during which the data in memory is held for almost the shelf life of battery power without any readout. The counters may be CMOS 4510 divide-by-ten BCD up-down counters, and the tri-state buffers may be CMOS 4503 tri-state hex buffers (noninverting).

Although particular embodiments of the invention have been described and illustrated herein, it is recognized that modifications and variations may readily occur to those skilled in the art. It is therefore intended that the claims be interpreted to cover such modifications and variations.

What I claim is:

1. A system for the selection and phase control of humbucking coils in a plurality of electromagnetic guitar pickups to permit the musician to easily select different sounds comprising a plurality of selection gates, each of which may be selected by a digital signal, one for each coil, a plurality of means, one for each coil, for buffering and selectively inverting or not inverting a coil signal, each of which may be selected by a digital signal, a summing means having a plurality of input terminals for receiving signals to be summed and amplified, and having a plurality of distinct gain factors each of which may be selected by a digital signal, said plurality of guitar pickups each having a pair of humbucking coils, each coil having one end connected directly to circuit ground and the other end coupled to said summing means by one of said selection gates and one of said selectively inverting and buffering means in cascade, digital memory means for storing different combinations of digital signals to select particular ones of said gates for the pickup coils to be used, to select particular ones of said selectively inverting means for selecting the phase of the coils selected, and to select said selectable gain factors of said summing means for the output level of the selected coils combined, and means for addressing said digital storage means to read out one of said different combinations of digital signals.

2. A system as defined in claim 1 wherein each of said plurality of selectively inverting or not inverting means is comprised of an operational amplifier connected by gating means in a configuration to provide a +K or a −K gain factor according to whether or not said gating means is open or closed by a digital signal.

3. A system as defined in claim 2 wherein said summing means is comprised of an operational amplifier with a plurality of feedback circuits from its output terminal to its inverting input terminal, each feedback circuit having a different resistance value and gating means opened or closed by a digital signal, and a plurality of coupling resistors of equal value, one for each different one of said selectively inverting means to couple the output thereof to the inverting input terminal of said operational amplifier of said summing means.

4. A system as defined in claim 1 wherein said addressing means is comprised of an up-down counter and a double-pole, double-throw, three-way switch having one pole connected to control the counter to count up or down according to which of two extreme positions it is placed in, and to hold a count when said one pole is in a neutral position, and the other pole connected to provide a single clock pulse to be counted for either of said two extreme positions.

5. A system as defined in claim 4 including means for displaying the count of said counter.

6. A system as defined in claim 5 wherein said digital memory means is a read-only memory.

7. A system as defined in claim 5 wherein said digital memory means is a read or write memory divided into three independent sections, and means for enabling each section individually for storing a digital code, each section being held in a read mode when not being enabled to store, and including data switches and a store command switch to set up digital codes to be stored in response to said data switches being set and to cause them to be stored in response to said store command switch being momentarily operated to close.

8. A system as defined in claim 4 including a plurality of additional up-down counters operated in parallel, an additional switch for producing a counter addressing code, a code converting means responsive to said additional switch code for selecting one of said counters, and selectively enabled buffer means for coupling out digital signals read out of a selectively enabled counter in response to enabling signal from said code converting means.

* * * * *